United States Patent [19]

Kofler

[11] Patent Number: 4,676,448

[45] Date of Patent: Jun. 30, 1987

[54] WINDING MACHINE FOR WINDING AND/OR UNWINDING WEB-LIKE GUIDED MATERIALS

[75] Inventor: Wilhelm Kofler, Uzwil, Switzerland

[73] Assignee: Benninger AG, Uzwil, Switzerland

[21] Appl. No.: 769,435

[22] Filed: Aug. 26, 1985

[30] Foreign Application Priority Data

Aug. 31, 1984 [CH] Switzerland ..... 4169/84

[51] Int. Cl.[4] ..... B65H 18/04; B65H 18/10; B65H 54/553

[52] U.S. Cl. ..... 242/67.1 R; 242/68.4; 242/129.6

[58] Field of Search ..... 242/67.1 R, 68.4, 58.6, 242/55.2, 79, 129.6, 129.62

[56] References Cited

U.S. PATENT DOCUMENTS

| | | | |
|---|---|---|---|
| 1,859,301 | 5/1932 | Lamatsch | 242/68.4 |
| 2,524,106 | 10/1950 | Hanson | 242/58.6 |
| 3,096,101 | 7/1963 | Raddeman | 242/68.4 X |
| 3,301,499 | 1/1967 | Ewing | 242/68.4 |
| 3,458,147 | 7/1969 | Teske et al. | 242/67.1 R X |
| 3,977,617 | 8/1976 | Salmon | 242/68.4 X |
| 4,230,286 | 10/1980 | Charles | 242/58.6 X |
| 4,365,768 | 12/1982 | Woodruff | 242/68.4 X |
| 4,409,710 | 10/1983 | Kofler | 242/68.4 X |

*Primary Examiner*—Stuart S. Levy
*Assistant Examiner*—Joseph J. Hail, III
*Attorney, Agent, or Firm*—Werner W. Kleeman

[57] ABSTRACT

The winding machine comprises a driving-side stand, an auxiliary-side stand, a support positioned between the driving-side stand and the auxiliary-side stand, and a beam, such as a journal beam containing journals or pins and clamped between the driving-side stand and the support. These journals or pins are provided with replaceable or exchangeable clamping or chucking cones. The driving-side stand and the support each possess a mating or counter-cone engagingly fitting the associated clamping or chucking cone.

19 Claims, 6 Drawing Figures

WINDING MACHINE FOR WINDING AND/OR UNWINDING WEB-LIKE GUIDED MATERIALS

CROSS REFERENCE TO RELATED APPLICATION

This application is related to my commonly assigned, copending U.S. application Ser. No. 774,004, filed Sept. 9, 1985, and entitled "Winding Machine for Winding and/or Unwinding Web-Like Guided Materials".

BACKGROUND OF THE INVENTION

The present invention broadly relates to a new and improved construction of a winding machine for selectively winding and unwinding web-like guided materials.

In its more specific aspects the present invention relates to an improved winding machine for winding and/or unwinding web-like guided materials or goods and comprises a driving-side stand, and auxiliary-side stand, a support positioned between the driving-side stand and the auxiliary-side stand, and a beam, such as a journal beam or mandrel, clamped between the driving-side stand and the support.

The clamping or chucking and the unclamping or unchucking of journal beams is associated with increased expenditure in equipment and working time. When the journal beam or mandrel is clamped or chucked it must be, for instance, raised into alignment with and be located in front of the journal take-up devices or receivers. As an alternative to this procedure the journal take-up devices or receivers themselves can be lowered until they are aligned with the journals or pins of the journal beam which is to be chucked. Only then can the journal beam be clamped or chucked by performing an axial movement of the journal take-up devices or receivers. If the journal take-up devices were previously lowered, then they must now be raised again. Only thereafter is it possible to arrest the journal beam at the journal take-up devices or receivers, whereafter it is then possible to place the journal beam into operation in order to perform the winding operation.

When the journal beams are unclamped or unchucked additional difficulties arises. The wound journal beam has a considerable weight, and it is for this reason that care must be taken to prevent the ends of the journals or pins from being loaded by the inherent weight of the journal beam. Unfortunately, this nevertheless does occasionally happen, so that the journals or pins no longer exactly align with the journal take-up devices or receivers. This defect is not readily noticed when the alignment deviation is only small. Nevertheless inexactly aligned journals or pins result in the journal beam failing to rotate concentrically enough in the winding machine, so that vibrations arise and the winding speed has to be limited. In extreme cases the winding of the web-like materials or goods, for example, a warp sheet, is disturbed.

SUMMARY OF THE INVENTION

Therefore with the foregoing in mind it is a primary object of the present invention to provide a new and improved construction of a winding machine which does not exhibit the aforementioned drawbacks and shortcomings of the prior art constructions.

A further important object of the present invention is to provide a new and improved construction of a winding machine which renders possible a disturbance-free and rapid clamping and unclamping of its winding beam, such as a journal beam.

Still another significant object of the present invention relates to an improved construction of a winding machine for the winding and unwinding of web-like materials or goods, wherein the winding beam onto which there is selectively wound and unwound the materials or goods being processed can be chucked and unchucked in the winding machine in a relatively rapid, highly reliable, disturbance-free and protective manner.

Yet a further important object of the present invention is to provide a new and improved construction of a winding machine of the character described which is equipped with means for the extremely rapid, positive, reliable and disturbance-free clamping and unclamping of the winding beam at which there is selectively wound and unwound the material being processed at the winding machine.

Now in order to implement these and still further objects of the invention which will become more readily apparent as the description proceeds, the winding machine of the present invention is manifested by the features that the journals or pins of the journal beam are equipped with replaceable or exchangeable clamping or chucking cones. The driving-side stand possesses a mating or counter-cone fitting the clamping or chucking cones, and the support also possesses a mating or counter-cone fitting the clamping or chucking cones.

The invention makes it possible to clamp and unclamp a journal beam or mandrel without the need to use any raising or lowering equipment. For example, for accomplishing the clamping or chucking of the journal beam the latter rests on the ground, for instance, upon its side discs or plates, wherein the rotational axis of the journal beam is located a few millimeters lower than the axis of rotation of the winding machine. For clamping such journal beam, the support and the complete winding machine are moved in the direction of the journal beam, whereby the clamping cones of the journal beam slide up along the mating or counter-cones until the journal beam axis is essentially coincident with the rotational axis of the winding machine. Now the journal beam or mandrel can be positionally locked or arrested and the winding operation can begin. The unclamping or unchucking of the journal beam occurs in reverse sequence.

To assure that the ends of the journals or pins are not loaded in any event during the unclamping or unchucking of the journal beam, a further development of the present invention contemplates that at least the portion of each clamping or unchucking cone which carries the journal beam is pushed so far along its associated journal or pin that the end of such journal or pin is free or exposed.

In this manner it can be assured that the journal or pin is loaded only at its rear portion, i.e. at the part of the journal or pin located adjacent the associated side disc or plate of the journal beam.

After the completion of the winding procedure the clamping or chucking cones are each pulled off the journals or pins. They cannot remain on their journals because at the place of use of the journal beam there could be possibly present a completely different type of take-up or receiving apparatus for the journal beam or mandrel. Such receiving apparatus could be constituted by an unwinding or delivery stand of the simplest type of construction.

To facilitate the attachment and detachment of the clamping cones a further aspect of the present invention contemplates providing the replaceable clamping or chucking cone with at least one clamping magnet. The clamping magnet or clamping magnets are advantageously positioned at the front or base side of the associated clamping or chucking cone. The clamping magnets can then bear at that location where the journal or pin merges with the associated side disc or plate or its hub and can bear upon one of these parts.

So that the replaceable or exchangeable clamping or chucking cones cannot scratch or damage the journals or pins or the mating or counter-cones, the clamping or chucking cones are advantageously manufactured of plastic.

To achieve a good clamping or chucking action it is necessary to provide a comparatively close fit between the journal or pin and the related clamping or chucking cone. In doing so there, however, exists the danger of jamming or seizing of the clamping cone on its journal in the event that the journal or pin exhibits surface damage or is no longer quite straight.

To prevent such jamming or seizing of the clamping or chucking cone upon its related journal or pin it is contemplated, according to a further development of the invention, to provide the clamping or chucking cone with a separating or parting joint or line. This separating or parting joint or line can consist, for example, of a radial cut or slit.

The mating or counter-cone of the driving-side stand is advantageously coaxially rotatably connected with a driving or drive disc. This driving or drive disc can, for example, be driven by a belt or equivalent drive element. Additionally, it can carry a brake disc or drum or can itself also be constructed as a brake disc or drum. Also the mating or counter-cone of the support is advantageously coaxially rotatably connected with a brake disc or drum.

A further aspect of the invention contemplates freely rotatably mounting the driving disc as well as the braking disc or drum by means of anti-friction bearings. For example, ball bearings, roller bearings, tapered roller bearings or equivalent bearing structures can be advantageously used as the anti-friction bearings.

According to a further development of the invention the mating or counter-cones of the driving-side stand and the support are removably connected with the driving disc and the brake disc or drum, respectively. Consequently, the driving or drive disc as well as the brake disc or drum can each be structured for the addition of a take-up apparatus for journal-free beams or mandrels. In the exceptional case that journal-free beams or mandrels must be received, the take-up apparatus used for this purpose, after the disassembly of the mating or counter-cones, is then mounted on the driving or drive disc and the brake disc or drum, respectively.

To allow for an easier clamping or chucking of the journal beam or mandrel and to enable the positional locking or arresting of the clamped journal beam or mandrel to be achieved speedily and without problems, a further development of the present invention provides positioning a respective anti-friction bearing between the driving disc or the brake disc or drum and the related mating or counter-cones. Each such anti-friction bearing is advantageously constructed as a self-adjusting anti-friction bearing. For this purpose a self-adjusting roller bearing has been found to be very suitable. Such self-adjusting anti-friction bearing makes it possible to also receive and safely or positively mount such journal beams or mandrels even when their journals or pins are not or no longer quite exactly aligned. Advantageously, the outer race or ring of the anti-friction bearing is connected with the driving disc or the brake disc or drum, as the case may be, and the inner race or ring of such anti-friction bearing is connected with the related mating or counter-cone.

According to a further development of the present invention the outer race or ring of the anti-friction bearing, besides being connected to the associated drive disc or the brake disc or drum, as the case may be, is also connected with an entrainment flange or flange member for the related side disc of the journal beam or mandrel. This entrainment flange possesses switchable or controllable entrainment pins. The entrainment flange or flange member therefore possesses a connection with the related drive disc or the brake disc or drum, as the case may be, and the related mating or counter-cone is freely rotatably mounted independently thereof. The above-mentioned switchable or controllable entrainment pins are, for example, constructed such that they can resiliently deviate or shift in the entrainment flange or flange member until, upon rotation of the entrainment flange or flange member relative to the journal beam or mandrel, they can come into latching or locking engagement with openings or holes of the related side disc or plate of the journal beam or mandrel. These entrainment pins are switchable or controllable because by performing suitable switching or control operations they can be then again released from their clamping or engaging position in the associated side disc or plate.

Since when using self-adjusting anti-friction bearings or bearing means the mating or counter-cone can run with unequal play against the parts carrying the associated self-adjusting anti-friction bearing and, furthermore, since the anti-friction bearings should be protected against dirt or contamination, a further construction of the invention contemplates positioning flexible sealing rings laterally of the anti-friction bearings. These flexible sealing rings are arranged between the mating or counter-cone, on the one hand, and the entrainment flange or respectively an intermediate disc connecting the entrainment flange of flange member with the driving or drive disc, on the other hand. It is particularly important in this regard that the sealing rings are flexible so that during relative movements of the mating or counter-cone the sealing of the anti-friction bearing is assured.

In accordance with a still further development of the present invention an entrainment pin-control or switching apparatus is positioned on the driving-side stand and/or on the support or support member. Such an entrainment pin-control apparatus especially facilitates the disengagement or delatching of the entrainment pins. Advantageously, the entrainment pin-control apparatus possesses for this purpose a control or switching ring which is positioned around the entrainment flange, is displaceable essentially parallel to the axis of the journal beam or mandrel, and acts upon switching or control levers of the entrainment pins. Such control or switching ring or ring member of the entrainment pin-control apparatus does not rotate together with the journal beam or mandrel. However, this control or switching ring engages with its inside edge behind the control or switching levers of the entrainment pins without, however, making contact with these switching levers during the rotation of the journal beam or mandrel. When the winding machine is at rest, the control or switching ring then can be displaced or moved away from the associated side disc or plate of the journal beam or mandrel, whereby its inner edge engages with or bears upon the switching levers and during a further displacement of such control or entrainment ring entrains the entrainment pins against the action of spring force and pulls them clear of the openings or holes of the associated side disc or plate. The control or switching ring or the entrainment pin-control apparatus is advantageously connected with the driving-side stand, respectively with the support, by means of a related lifting or displacement apparatus. This lifting or displacement apparatus can advantageously contain commonly controllable or switchable lifting or displacement cylinders. For example, at each control or switching ring there can engage three or four lifting or displacement cylinders which are substantially evenly distributed around the circumference of the control or switching ring.

Since the control rings possess the largest diameter of all of the aforementioned parts of the journal beam or mandrel take-up structure, there is provided, according to a still further development of the present invention, a protective cover for the associated control or switching ring of the entrainment pin-control apparatus for the purpose of enclosing or covering the rotating parts of the driving-side stand or the support, respectively. This protective cover is advantageously removably connected with the related control or switching ring of the entrainment pin-control apparatus, so that occasional inspection can be undertaken, as required.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
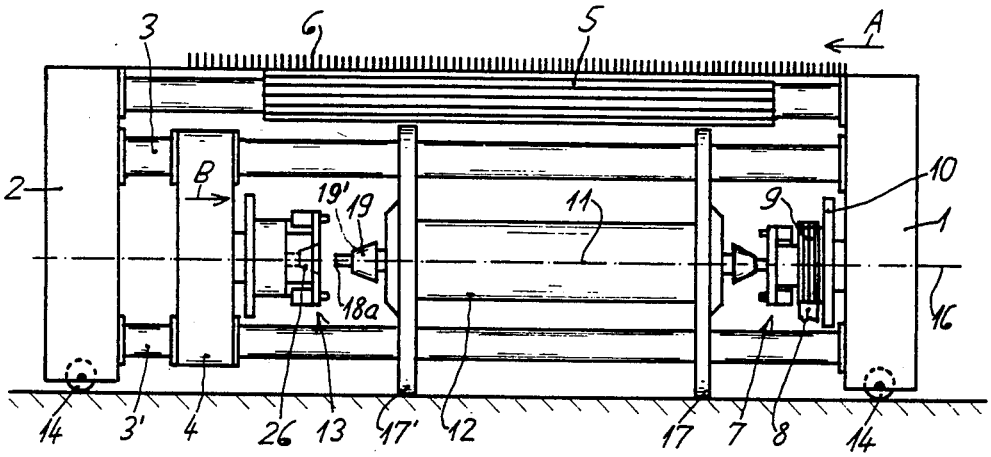
FIG. 1 illustrates a front view of an inventive winding machine constructed as a beam warping machine.

Describing now the drawings, it is to be understood that to simplify the showing thereof only enough of the structure of the winding machine has been illustrated therein as is needed to enable one skilled in the art to readily understand the underlying principles and concepts of the present invention. Turning now specifically to FIG. 1 of the drawings, the equipment depicted by way of example and not limitation therein will be seen to comprise a winding machine constructed as a beam warping machine equipped with a driving-side stand 1 and an auxiliary-side stand 2 which are connected with one another through traverses or crossties 3, 3'. These side stands 1 and 2 carry a deflection measuring roll 5 for deflecting a not particularly here shown warp sheet and serving for measuring the travelling speed or velocity of such warp sheet which will be wound-up later. These side stands 1 and 2 also carry a warp comb 6 which guides the threads of the warp sheet.

The driving-side stand 1 carries a driving-side beam take-up or receiving apparatus, referenced in its totality with the reference numeral 7, for a journal beam or mandrel 12. From FIG. 1 it can be recognized that the beam take-up or receiving apparatus 7 possesses a driving or drive disc 9 which is connected with a brake or braking disc or drum 10. This driving or drive disc 9 is driven by any suitable and therefore not particularly shown drive unit by means of a belt 8 or equivalent drive element.

The support-side beam take-up or receiving apparatus for the journal beam or mandrel 12 is conveniently referenced in its totality with the reference numeral 13.

The driving-side stand 1 as well as the auxiliary-side stand 2 are each equipped with displacement or travel rollers or rolls 14. For the take-up or chucking of the journal beam or mandrel 12 the complete winding machine can be readily displaced in the direction of the arrow A of FIG. 1 while simultaneously displacing a support or support member 4 in the direction of the arrow B of FIG. 1. A sideways or lateral displacement of the journal beam or mandrel 12 is not necessary. As long as the journal beam or mandrel 12 is still resting on the ground its rotational axis 11 lies a few millimeters beneath the axis of rotation 16 of the winding machine. Only after clamping or chucking of the journal beam 12 does the rotational axis 11 of the journal beam or mandrel 12 coincide with the axis of rotation 16 of the winding machine, thus forming a common axis, and the journal beam or mandrel 12 can rotate freely about this common axis because its two side discs or plates 17, 17' are then raised a few millimeters above the ground or floor.

FIG. 1 reveals that the support or support member 4 is mounted on the traverses or crossties 3 and 3' and can be displaced along these traverses 3 and 3'. The displacement mechanism required for this purpose has not been particularly illustrated in the drawings since the same is conventional and also such does not form subject matter of the present invention. Once the support 4 has reached the desired final or terminal position it can be appropriately positionally locked on the traverses or crossties 3, 3'.

Figure 2:
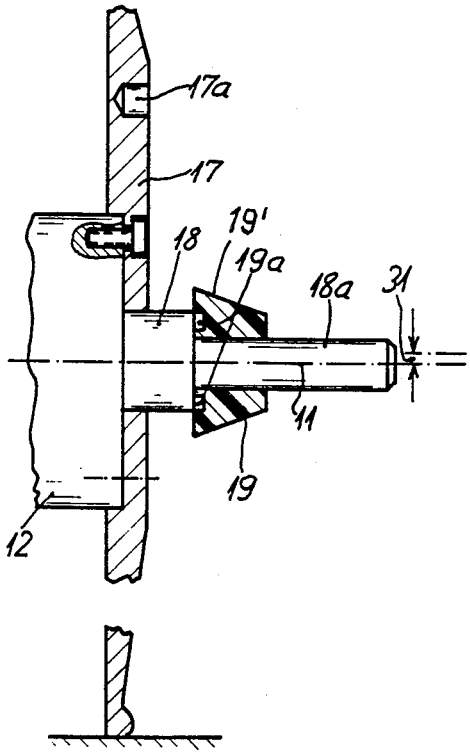
FIG. 2 shows a sectional representation of parts of the journal beam or mandrel thereof.

In accordance with the showing of FIGS. 1 and 2 it will be recognized the journal beam or mandrel 12 is bolted or otherwise appropriately fixed at its not particularly referenced opposite ends to its side discs or plates 17 and 17', respectively. The end of the journal beam 12 located adjacent the side disc or plate 17 possesses a hub 18 which merges into a journal or pin 18*a* having journal or pin ends. The side discs or plates 17, 17' contain entrainment openings or holes 17*a* which serve for driving of the journal beam or mandrel 12, as will be explained more fully hereinafter. In FIG. 2 such an entrainment opening or hole 17*a* is visible in the side disc or plate 17. A replaceable or exchangeable clamping or chucking cone 19 having a base portion confronting the forward is pushed onto the journal or pin 18*a* and is held seated against the hub 18 at its base portion by means of, for instance, therein embedded clamping or fixing magnets 19*a* provided in the lower region or base or base portion of such clamping or chucking cone 19. This clamping or chucking cone 19 is pushed so far onto its related journal or pin 18*a* that its journal or pin ends are free. The clamping or chucking cone 19 covers only about one-third of the length of the associated journal or pin 18*a*.

The clamping or chucking cone 19 is advantageously manufactured from a suitable plastic material. For example, a multi-layered material has been advantageously used for this purpose, namely a high-strength hard paper impregnated with resin and cured. This material is heat resistant and not brittle. Additionally, it is resistant to compression and over long periods of time shows no signs of aging or fatigue. Also the clamping or chucking cone 19 should advantageously contain a separating or parting joint or line or slit, generally indicated in FIG. 1 by reference numeral 19', in order to prevent its jamming or seizing on the associated journal or pin 18*a* and which parting joint or line or slit 19' should be formed by means of a radial or axial cut. This separating or parting joint or line or slit 19' is only generally indicated in FIG. 1 and can be assumed to lie in the section plane of the clamping or chucking cone 19 shown in FIG. 2. Additionally, the separating or parting joint or line or slit 19' also serves for accomplishing a play-free clamping or chucking of the journal beam 12 between each journal or pin 18*a*, the associated clamping or chucking cone 19 and an associated mating or counter-cone 26.

Figure 3:
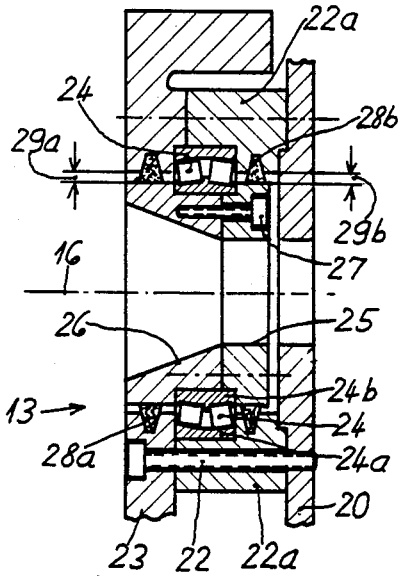
FIG. 3 shows a section through parts of the take-up apparatus of the journal beam or mandrel.
Figure 4:
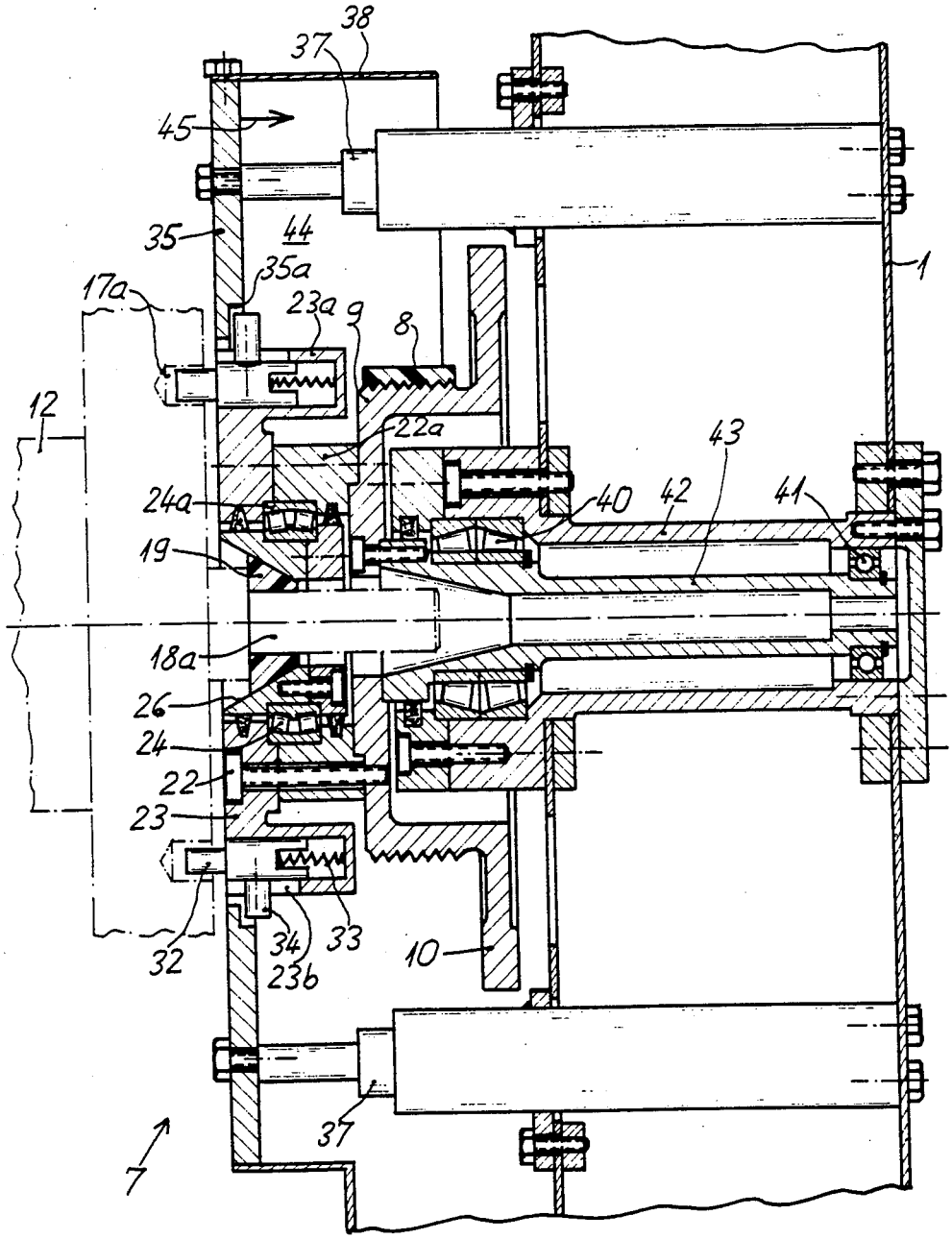
FIG. 4 shows a section through the driving-side mounting of the journal beam or mandrel.

The driving-side beam take-up or receiving apparatus 7 of the driving-side stand 1 is, in accordance with the illustration of FIG. 4, provided with the mating or counter-cone 26 fitting the associated clamping or chucking cone 19. In accordance with the showing of FIG. 3 and FIG. 5*a*, the support-side beam take-up or receiving apparatus 13 is also provided with a mating or counter-cone 26 fitting the associated clamping or chucking cone 19. The mating or counter-cone 26 of the driving-side stand 1 is coaxially rotatably connected with the related driving disc 9 on the common axis formed by the axis of rotation 16 of the winding machine and the rotational axis 11 of the journal beam or mandrel 12. Thus, the mating or counter-cone 26 also is operatively connected with the braking disc or drum 10. In accordance with the showing of FIG. 3 and FIG. 5*a*, the mating or counter-cone 26 of the support or support member 4 is also coaxially rotatably connected with the associated brake disc or drum 20. This is accomplished in both cases by means of suitable anti-friction bearings 24, such as, for instance, self-adjusting or self-aligning roller bearings 24. An outer race or ring 24*a* of the anti-friction bearing 24 is, in accordance with the showing of FIG. 4, connected with an entrainment flange or flange member 23 and, by means of an intermediate disc 22*a* connecting the entrainment flange or flange member 23 with the driving or drive disc 9, is also connected with the braking disc 10.

Figures 5A, 5B:
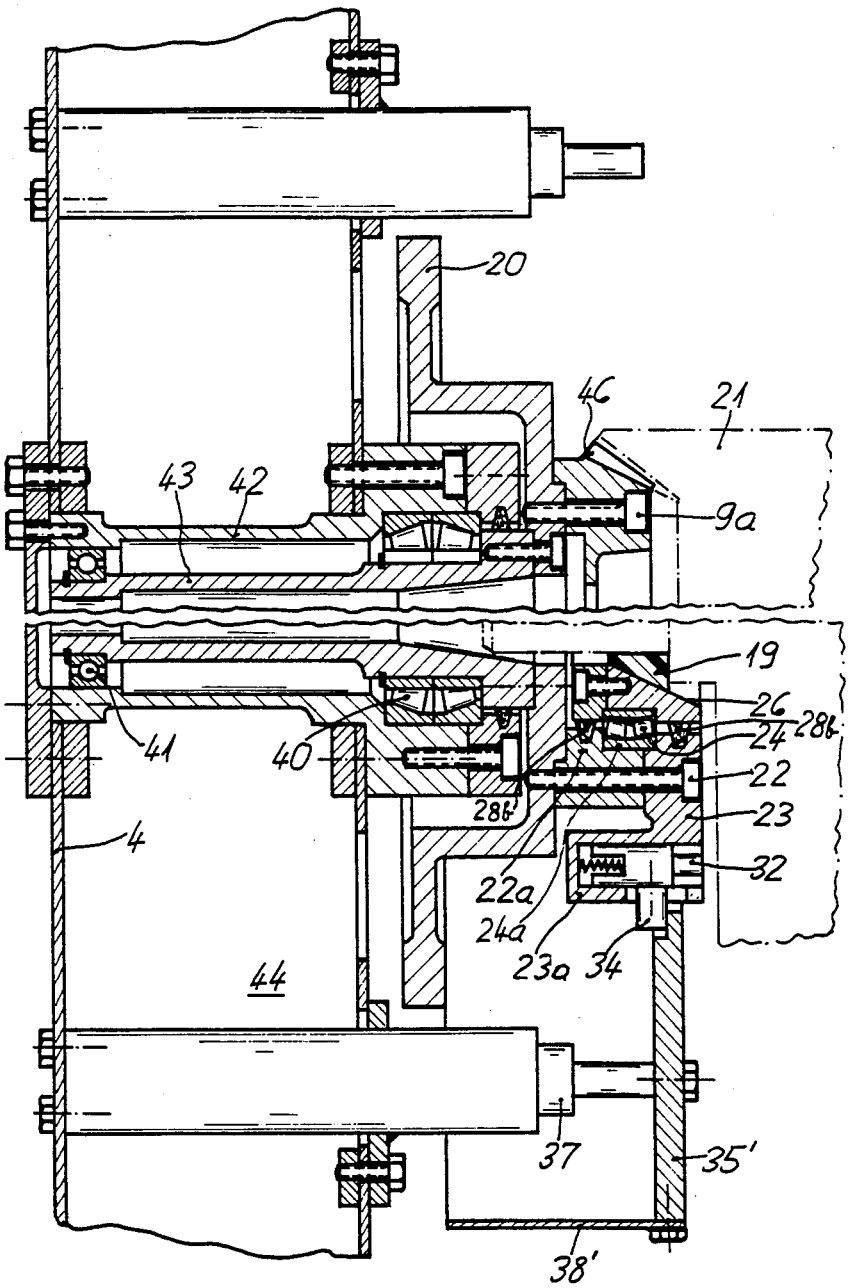
FIG. 5*a* shows a section through the support-side mounting of the journal beam or mandrel.
FIG. 5*b* shows a section through the support-side mounting after equipment changeover or modification for the take-up of a journal-free beam or mandrel.

In accordance with FIG. 5*a*, the outer race or ring 24*a* of the anti-friction bearing 24 is connected with its associated entrainment flange or flange member 23 and, by means of an intermediate disc 22*a* connecting the entrainment flange or flange member 23 with the brake disc or drum 20, is also connected with such brake disc or drum 20. An inner race or ring 24*b* of the anti-friction bearing 24 is in each case connected with the associated mating or counter-cone 26. Laterally of the anti-friction bearing 24 there are positioned flexible or resilient sealing rings 28*a* and 28*b* (see FIGS. 3 and 5*a*). The sealing ring 28*a* lies in a not particularly referenced groove of the associated entrainment flange or flange member 23 and bears against the mating or counter-cone 26. The sealing ring 28*b* reposes in a likewise not particularly referenced groove of the intermediate disc 22*a* and bears against a cover or cover member 25 which is connected with the mating or counter-cone 26 by means of bolts 27 or the like.

Both the driving or drive disc 9 as well as the brake disc or drum 20 are freely rotatably mounted by means of anti-friction bearings 40, 41. These anti-friction bearings 40, 41 are embedded in carrier or support tubes 42 which are connected with the driving-side stand 1 and the support or support member 4, respectively. The anti-friction bearings 40, 41 in each case support a related hollow shaft 43. One such hollow shaft 43 is fixed, by means of not particularly referenced bolts or the like on one side of the winding machine to the driving or drive disc 9 equipped with the brake disc or drum 10 (see FIG. 4), and on the support side of the winding machine the other such hollow shaft 43 is fixed by not particularly referenced bolts or the like to the brake disc or drum 20 (see FIG. 5*b*).

The mating or counter-cones 26 of the driving-side stand 1 and the support or support member 4 are releaseably connected with the driving disc 9 and with the brake disc or drum 20, respectively. For this purpose bolts 22 or the like are used which hold the entrainment flange or flange member 23 and the intermediate disc 22*a* against the driving disc 9 and the brake disc or drum 20, respectively. The outer races or rings 24*a* of the anti-friction bearings 24 rest in not particularly referenced recesses of the entrainment flange or flange member 23 and the intermediate disc 22*a*. In this way it is assured that the mating or counter-cones 26, even though connected with the drive disc 9 and the brake disc or drum 20, respectively, can nevertheless rotate independently of these discs.

As best seen by referring to FIG. 4 and FIG. 5*a*, the entrainment flange or flange member 23 carries the entrainment pins 32 which are mounted in sleeves 23*a*. Each entrainment pin 32 is provided with a switching or control lever 34 which projects radially outwards through a slot 23*b* in the associated sleeve 23*a*. Compression or pressure springs 33 load the entrainment pins 32 in such a manner that they are displaced in the direction of the journal beam or mandrel 12.

In accordance with the showing of FIG. 4, the driving-side stand 1 possesses an entrainment pin-control or switching apparatus or device referenced in its totality by reference numeral 44. Support 4 possesses the same type of entrainment pin-control or switching apparatus or device 44. Each entrainment pin-control or switching apparatus 44 possess a control or switching ring or ring member 35 which is arranged around the related entrainment flange or flange member 23, is displaceable essentially parallel to the axis 11 of the journal beam or mandrel 12 and acts on the switching or control levers 34 of the entrainment pins 32. Each such control or switching ring 35 is connected to the driving-side stand 1 or with the support 4, as the case may be, by means of an associated entrainment pin lifting or displacement arrangement in the form of commonly switchable or controllable lifting or displacement means or cylinders 37. For instance, if the lifting or displacement cylinders 37, in accordance with FIG. 4, move the control or switching ring 35 in the direction of the arrow 45 then a recess 35*a* or the like in such control or switching ring 35 entrains the switching or control levers 34 of the entrainment pins 32 against the force of the compression or pressure springs 33, whereby the entrainment pins 32 move out of the entrainment openings or holes 17*a* of the related side disc or plate 17 or 17', as the case may be.

Therefore, when the entrainment pins 32 are pulled back or retracted, the entrainment pin-control apparatuses 44 permit the journal beam or mandrel 12, firstly, to be clamped tightly against the clamping or chucking cones 19, then in the clamped condition to turn or rotate, and thus, allow the entrainment pins 32 to snap or latch into the associated entrainment openings or holes 17*a* or the side discs 17, 17'. The opposite procedure is carried out when the journal beam or mandrel 12 is unclamped. First the entrainment pins 32 are withdrawn from the entrainment openings or holes 17*a* of the side discs or plates 17, 17' while the journal beam or mandrel 12 is still clamped fast. Then the support or support member 4 either alone, or at the same time also the complete winding machine, can be moved sideways in the opposite direction, whereby the clamping or chucking cones 19 slide down along the mating or counter-cone 26, whereby the rotational axis 11 of the journal beam or mandrel 12 is lowered compared with the axis of rotation 16 of the winding machine by the amount of a difference 31 shown in FIG. 2 until these side discs or plates 17, 17' lie on the ground. Thereafter the side-stands 1 and 2 can be moved further apart relative to the support 4, so that the journals or pins 18*a* are freed to such an extent that the wound journal beam or mandrel 12 can be rolled on the floor out of the winding machine.

From FIG. 3 it can be recognized that because of the arrangement of the self-adjusting anti-friction bearing 24 the play 29*a* between the mating or counter-cone 26 and the entrainment flange or flange member 23 can be altered. For the same reasons the play 29*b* between the cover or cover member 25 and the intermediate disc 22*a* can also be altered.

From FIGS. 4 and 5*a* it can be recognized that each control or switching ring 35 and 35' of the entrainment pin-control apparatuses 44 possesses a contact-protective cover 38 and 38', respectively, which protects the rotating parts of the driving-side stand 1 and the support 4, respectively. These protective covers 38 and 38' are releasably connected to their associated control or switching rings 35 and 35', respectively, of the related entrainment pin-control apparatus 44, by means of bolts or equivalent fastening expedients. The protective cover 38 possesses an opening or passage for the drive belt 8, which opening or passage, however, is not necessary for the other protective cover 38'. The driving disc 9 as well as the brake disc or drum 20 can be prepared for the mounting of a take-up or engaging device 46 for journal-free beams or mandrels 21 (FIG. 5*b*). The entrainment flanges 23, the intermediate discs or plates 22*a* and the mating or counter-cones 26 together with their anti-friction bearings 24 can be removed by releasing the bolts 22. Instead of these components or parts, the beam take-up or engaging devices 46 shown in FIG. 5*b* can be secured by means of bolts 9*a* to the brake disc or drum 20 or at the other drive side of the winding machine to the drive or driving disc 9. The beam take-up or engaging devices 46 possess a substantially conical outer tooth rim or external teeth which mesh with an inner tooth rim or internal teeth of the journal-free beam or mandrel 21.

While there are shown and described present preferred embodiments of the invention, it is to be distinctly understood that the invention is not limited thereto, but may be otherwise variously embodied and practiced within the scope of the following claims.

What I claim is:

1. A winding machine for winding or unwinding web-like guided materials, comprising:

a driving-side stand;

an auxiliary-side stand;

a support arranged between said driving-side stand and said auxiliary-side stand;

a journal beam containing opposite ends and clampingly positioned between said driving-side stand and said support at the region of said opposite ends;

said journal beam containing journals at said opposite ends thereof;

one of said journals being located at the neighborhood of said driving-side stand and the other of said journals being located at the neighborhood of said support;

a respective exchangeable clamping cone provided for each of said journals;

a counter-cone provided for said driving-side stand and matingly fitting said clamping cone provided at the journal neighboring said driving-said stand;

a counter-cone provided for said support and matingly fitting said clamping cone provided at the journal neighboring said support;

each of said exchangeable clamping cones having a base portion; and at least one fixing magnet positioned at said base portion of each said exchangeable clamping cone.

2. The winding machine as defined in claim 1, wherein:

each said exchangeable clamping cone is formed of a plastic material.

3. The winding machine as defined in claim 1, wherein:

each said exchangeable clamping cone contains a separating joint preventing seizing of said clamping cone on its associated journal.

4. The winding machine as defined in claim 1, further including:

a driving disc provided for said driving-side stand; and said counter-cone which is located at the neighborhood of said driving-side stand being rotatably connected on a common axis with said driving disc.

5. The winding machine as defined in claim 4, further including:

a braking disc provided for said support; and said counter-cone which is located at the neighborhood of said support being rotatably connected on a common axis with said braking disc.

6. The winding machine as defined in claim 5, further including:

anti-friction bearing means for freely rotatably mounting said driving disc and said braking disc.

7. The winding machine as defined in claim 5, further including:

means for removably connecting said counter-cone of said support with said braking disc.

8. The winding machine as defined in claim 4, further including:

means for removably connecting said counter-cone of said driving-side stand with said driving disc.

9. A winding machine for winding or unwinding web-like guided materials, comprising:

a driving-side stand;

an auxiliary-side stand;

a support arranged between said driving-side stand and said auxiliary-side stand;

a journal beam containing opposite ends and clampingly positioned between said driving-side stand and said support at the region of said opposite ends;

said journal beam containing journals at said opposite ends thereof;

one of said journals being located at the neighborhood of said driving-side stand and the other of said journals being located at the neighborhood of said support;

a respective exchangeable clamping cone provided for each of said journals;

a counter-cone provided for said driving-side stand and matingly fitting said clamping cone provided at the journal neighboring said driving-side stand;

a counter-cone provided for said support and matingly fitting said clamping cone provided at the journal neighboring said support;

a driving disc provided for said driving-side stand;

said counter-cone which is located at the neighborhood of said driving-side stand being rotatably connected on a common axis with said driving disc;

anti-friction bearing means positioned between said driving disc and said counter-cone located at the neighborhood of said driving-side stand;

said anti-friction bearing means comprising an outer race and an inner race; and said outer race being connected with said driving disc and said inner race being connected with said counter-cone located at the neighborhood of said driving-side stand.

10. The winding machine as defined in claim 9, further including:

a controllable entrainment flange possessing controllable entrainment pins;

said journal beam being provided with at least one side disc located at the neighborhood of said driving-side stand;

said controllable entrainment flange being provided for said at least one side disc of said journal beam; and said outer race of said anti-friction bearing means being connected with said controllable entrainment flange.

11. The winding machine as defined in claim 10, further including:

resilient sealing rings arranged laterally of the anti-friction bearing means between said counter-cone provided for said driving-side stand and said entrainment flange.

12. The winding machine as defined in claim 10, further including:

an intermediate disc connecting the entrainment flange with the driving disc; and resilient sealing rings arranged laterally of the anti-friction bearing means between said counter-cone provided for said driving side stand and said intermediate disc connecting the entrainment flange with the driving disc.

13. The winding machine as defined in claim 10, further including:

an entrainment pin-control device arranged at the driving-side stand;

said entrainment pin-control device comprising a control ring;

switching levers provided for said controllable entrainment pins;

said control ring acting upon said switching levers; and said control ring being arranged about said entrainment flange and being displaceable substantially axially parallel with respect to said journal beam.

14. The winding machine as defined in claim 13, further including:

displacement means for connecting said control ring with said driving-side stand.

15. A winding machine for winding or unwinding web-like guided materials, comprising:

a driving-side stand;

an auxiliary-side stand;

a support arranged between said driving-side stand and said auxiliary-side stand;

a journal beam containing opposite ends and clampingly positioned between said driving-side stand and said support at the region of said opposite ends;

said journal beam containing journals at said opposite ends thereof;

one of said journals being located at the neighborhood of said driving-side stand and the other of said journals being located at the neighborhood of said support;

a respective exchangeable clamping cone provided for each of said journals;

a counter-cone provided for said driving-side stand and matingly fitting said clamping cone provided at the journal neighboring said driving-side stand;

a counter-cone provided for said support and matingly fitting said clamping cone provided at the journal neighboring said support;

a driving disc provided for said driving-side stand;

said counter-cone which is located at the neighborhood of said driving-side stand being rotatably connected on a common axis with said driving disc;

a braking disc provided for said support;

said counter-cone which is located at the neighborhood of said support being rotatably connected on a common axis with said braking disc;

anti-friction bearing means positioned between said braking disc and said counter-cone located at the neighborhood of said support;

said anti-friction bearing means comprising an outer race and an inner race; and said outer race being connected with said braking disc and said inner race being connected with said counter-cone located at the neighborhood of said support.

16. The winding machine as defined in claim 15 further including:

a controllable entrainment flange possessing controllable entrainment pins;

said journal beam being provided with at least one side disc located at the neighborhood of the support;

said entrainment flange being provided for said at least one side disc of said journal beam; and said outer race of said anti-friction bearing means being connected with said entrainment flange.

17. The winding machine as defined in claim 16, further including:

resilient sealing rings arranged laterally of the anti-friction bearing means between said counter-cone provided for said support and said entrainment flange.

18. The winding machine as defined in claim 16, further including:

an entrainment pin-control device arranged at the support;

said entrainment pin-control device comprising a control ring;

switching levers provided for said controllable entrainment pins;

said control ring acting upon said switching levers; and said control ring being arranged about said entrainment flange and being displaceable substantially axially parallel with respect to said journal beam.

19. The winding machine as defined in claim 18, further including:

displacement means for connecting said control ring with said support.

* * * * *

UNITED STATES PATENT AND TRADEMARK OFFICE

CERTIFICATE OF CORRECTION

PATENT NO. : 4,676,448

DATED : June 30, 1987

INVENTOR(S) : WILHELM KOFLER

It is certified that error appears in the above-identified patent and that said Letters Patent is hereby corrected as shown below:

Column 1, line 44, please delete "arises" and insert --arise--

Column 4, line 45, please delete "of" and insert --or--

Column 10, line 29, please delete "driving-said" and insert --driving-side--

Signed and Sealed this

Twenty-third Day of February, 1988

*Attest:*

DONALD J. QUIGG

*Attesting Officer*

*Commissioner of Patents and Trademarks*